US009970139B2

(12) United States Patent
Belloni et al.

(10) Patent No.: US 9,970,139 B2
(45) Date of Patent: May 15, 2018

(54) MICROFIBROUS PRODUCT AND THE USE THEREOF FOR THE PREPARATION OF COVERS AND CASES

(71) Applicant: ALCANTARA S.P.A., Milan (IT)

(72) Inventors: Giovanni Belloni, Terni (IT); Carmine Carlo Ammirati, Terni (IT); Giovanni Addino, Terni (IT); Francesco Panetti, Spoleto (IT); Walter Cardinali, Marsciano (IT); Gianni Romani, Terni (IT); Carlo Costa, Rieti (IT); Marcello Concezzi, Terni (IT)

(73) Assignee: ALCANTARA S.P.A., Milan (IT)

( * ) Notice: Subject to any disclaimer, the term of this patent is extended or adjusted under 35 U.S.C. 154(b) by 279 days.

(21) Appl. No.: 15/081,421

(22) Filed: Mar. 25, 2016

(65) Prior Publication Data

US 2016/0208423 A1 Jul. 21, 2016

Related U.S. Application Data

(62) Division of application No. 14/350,465, filed as application No. PCT/IB2013/050261 on Jan. 11, 2013.

(30) Foreign Application Priority Data

Jan. 17, 2012 (IT) ..... MI2012A0043

(51) Int. Cl.
*D04H 1/4382* (2012.01)
*D06N 3/00* (2006.01)
(Continued)

(52) U.S. Cl.
CPC ..... *D04H 1/4382* (2013.01); *D04H 1/465* (2013.01); *D04H 1/488* (2013.01); *D04H 1/49* (2013.01);
(Continued)

(58) Field of Classification Search
USPC ..... 540/95; 552/636; 428/36.1; 442/363; 28/16
See application file for complete search history.

(56) References Cited

U.S. PATENT DOCUMENTS 9,816,213 B2 * 11/2017 Belloni ..... D04H 1/4382
2003/0151154 A1 8/2003 Bellucci et al.
(Continued)

FOREIGN PATENT DOCUMENTS

CN 1222437 A 7/1999
DE 19728882 C1 11/1998
(Continued)

OTHER PUBLICATIONS

Database WPI, Week 197547, Thomson Scientific, London, GB; AN 1975-77632W, XP002683707, & -JP 50 042004 A (Kuraray Co Ltd), Apr. 16, 1975 (Apr. 16, 1975), 1 page.
(Continued)

*Primary Examiner* — Lynda Salvatore
(74) *Attorney, Agent, or Firm* — Pearne & Gordon LLP

(57) ABSTRACT

The invention refers to a process for the preparation of a microfibrous non-woven fabric based on polyester or polyamide microfibers immersed in a polyurethane matrix, and having a thickness equal to or less than 0.65 mm, a flat or slightly mottled appearance and a nap length of less than 350 μm. The non-woven fabric is used for the preparation of coverings for consumer goods, particularly for the preparation of covers and cases for electronic products.

12 Claims, 5 Drawing Sheets

(51) Int. Cl.

| | |
|---|---|
| ***D06N 3/14*** | (2006.01) |
| ***D04H 1/46*** | (2012.01) |
| ***D04H 1/488*** | (2012.01) |
| ***D04H 11/08*** | (2006.01) |
| ***D06C 11/00*** | (2006.01) |
| ***D06C 15/00*** | (2006.01) |
| ***D04H 1/49*** | (2012.01) |

(52) U.S. Cl.

CPC ..... *D04H 11/08* (2013.01); *D06C 11/00* (2013.01); *D06C 15/00* (2013.01); *D06N 3/0004* (2013.01); *D06N 3/0011* (2013.01); *D06N 3/0034* (2013.01); *D06N 3/0036* (2013.01); *D06N 3/0075* (2013.01); *D06N 3/14* (2013.01); *D06N 2211/28* (2013.01); *Y10T 428/1362* (2015.01); *Y10T 428/2395* (2015.04)

(56) References Cited

U.S. PATENT DOCUMENTS

| | | | |
|---|---|---|---|
| 2004/0063366 | A1 | 4/2004 | Nakayama et al. |
| 2007/0066173 | A1 | 3/2007 | Teofrasti et al. |
| 2011/0070422 | A1 | 3/2011 | Ammirati et al. |

FOREIGN PATENT DOCUMENTS

| | | | |
|---|---|---|---|
| EP | 0584511 | A1 | 3/1994 |
| EP | 1323859 | A2 | 7/2003 |
| EP | 1403421 | A2 | 3/2004 |
| EP | 1760189 | A2 | 3/2007 |
| JP | S50042004 | A | 4/1975 |
| JP | S57199876 | A | 12/1982 |
| JP | S59011713 | B2 | 3/1984 |
| JP | 2002180382 | A | 6/2002 |
| JP | 2003082587 | A | 3/2003 |
| JP | 2004091960 | A | 3/2004 |
| JP | 2005097821 | A | 4/2005 |

OTHER PUBLICATIONS

Database WPI, Week 198415, Thomson Scientific, London, GB; AN 1984-092706, XP002683708, -& JP 59 011713 B2 (Asahi Chem Ind Co Ltd), Mar. 17, 1984 (Mar. 17, 1984), 1 page.

Database WPI, Week 198303, Thomson Scientific, London, GB; AN 1983-06387K, XP002683709, -& JP 57 199876 A (Asahi Chem Ind Co Ltd), Dec. 7, 1982 (Dec. 7, 1982), 1 page.

* cited by examiner

MICROFIBROUS PRODUCT AND THE USE THEREOF FOR THE PREPARATION OF COVERS AND CASES

The object of the present invention is a microfibrous non-woven fabric with a suede-like look, reduced thickness and a flat or slightly mottled appearance, to be used for the preparation of coverings for consumer goods, preferably for the preparation of covers and cases for consumer goods, particularly for electronic products. Examples of consumer goods include: portable devices for recording or reproducing sounds or images, portable entertainment devices, sports weapons or equipment, devices for personal well-being or health, telephones, handheld computers, laptops, and other electronic devices.

The invention also concerns a process for obtaining this non-woven fabric and the coverings that can be obtained by this non-woven fabric.

Non-woven fabrics in composite material that have the look of natural leather are known in the field, but the characteristics relating to the hand, lightweightness, nap and light fastness are superior to those of natural leather.

Such non-woven fabrics are obtained starting from polymeric microfibres, preferably polyester or polyamide microfibres, by means of the spinning technology called "islands in the sea".

One begins by extruding a bicomponent bundle of continuous filaments through a spinneret. Each individual filament, in turn, contains numerous and very thin polyester or polyamide microfilaments, preferably 16 filaments. The microfilaments (islands) are so thin and difficult to work that the presence of a sheath (sea) is required as support. The polymer polystyrene (PS) is used as the sea component.

The fibres thus produced form a single band (tow) and undergo the ironing, crimping and cutting process until a short fibre (flock) is obtained and then collected in bales for the subsequent process consisting of the transformation into felt.

By means of the carding process, the flock is transformed into a thin sheet of material (card veil) overlapped many times until the mattress (overlapping of many veils) is formed.

The binding of the fibres to each other requires a complex needle-punching process, which is carried out through a series of boards containing special needles that mechanically interlace the fibres.

The felt thus obtained is impregnated with an adhesive, preferably a polyvinyl adhesive, with the aim of protecting the microfibres before dissolution of the sea component. The sea component, constituting the sheath of the microfibres, is subsequently dissolved with a selective solvent, preferably trichloroethylene.

This is followed by a step consisting of impregnation with a polyurethane binding agent in solvent (dimethylformamide).

Finally, the polyurethane coagulates and at the same time, the adhesive dissolves.

The intermediate product thus obtained is cross-cut continuously (splitting), thereby creating two equal sections from a single roll. The high precision of this process ensures uniformity in the thickness and in the characteristics of the finished product, and is a necessary condition for the success of the downstream processing steps.

The surfaces of the products thus obtained are processed with special abrasive papers (buffing) for the purpose of making the very thin microfibres emerging, giving the product a look characterised by the mottling of the surface, by a natural writing effect and a pleasant touch.

The raw step ends with a visual inspection serving for identification of even the smallest defect in appearance.

The dyeing process is carried out by a series of JET dyeing machines operating under pressure with a capacity varying between 70 to 2000 meters. Dyeing of the microfibrous component takes place owing to the colorants dispersed, which are suitably selected to give the tone and the desired performances.

Following the dyeing process, the product is submitted to a finishing treatment that serves to impart particular characteristics such as softness, antistatic protection and water-resistance.

The composite non-woven fabric thus obtained is utilised in various sectors to cover many surfaces and forms: in the automobile sector (for interior coverings), in interior design (principally for seating and fittings), in the yachting sector, and in the clothing and accessories sector.

In spite of the extensive use of microfibrous non-woven fabric in various sectors, the need still remains to find new uses for this material in sectors where it has not been employed yet.

Therefore, the Applicant has addressed the problem of how to adapt the known microfibrous non-woven fabric for use in the preparation of coverings for consumer goods, preferably for the preparation of covers and cases for consumer goods, particularly for electronic devices. Examples of consumer goods include: portable devices for recording or reproducing sounds or images, portable entertainment devices, sports weapons or equipment, devices for personal well-being or health, telephones, handheld computers, laptops and other electronic devices.

The problem to be resolved is therefore the realisation of a microfibrous product with a suede-like look, of a thickness equal to or less than 0.65 mm, preferably equal to or less than 0.60 mm, and having a flat or slightly mottled appearance, to be used for the preparation of coverings for consumer goods, preferably for the preparation of covers and cases for consumer goods, preferably for electronic devices. Examples of such consumer goods include: portable devices for recording or reproducing sounds or images, portable entertainment devices, sports weapons or equipment, devices for personal well-being or health, telephones, handheld computers, laptops and other electronic devices.

In this market, a thin thickness and absence of mottling are important requisites.

A thin thickness is required in the case of hard coverings in order to be able to cover many different shapes and to be able to be inserted within normal production processes without altering the overall thickness of the finished product, in the case of soft coverings in order to ensure sufficient pliancy, and in the particular case of covers or cases that house magnetic closures, the magnetic strength of which would be excessively reduced by a covering material that is too thick.

The absence of mottling (or mottling that is not pronounced) is important in a standardised mass market in which the consumer, being used to the homogenous look of the traditional, painted plastic or metal coverings, could interpret the mottling as a defect.

The known microfibrous non-woven fabrics are normally characterised by a mottled appearance, whereas the non-woven fabric according to the invention has a flat or slightly mottled appearance that is more appealing to consumers in the market of the applications cited herein.

For this category of non-woven fabrics, the term "mottling of the surface" is intended as a spotted appearance with a presence of light/dark tone-on-tone blotches, of completely random size, shape and distribution, and that give the product an irregular appearance typical of natural products (which, however, could be interpreted as a defect in the applications according to the invention).

Therefore, a non-woven fabric with a mottled appearance can be defined as a non-woven fabric in which the mottling of the surface is clearly evident and diffused, and the contrasting effects of light and shade are marked. The phenomenon can be seen clearly also with reference to FIG. 1 attached hereto, in which the presence of the details described above is evident.

A non-woven fabric with a slightly mottled appearance can instead be defined as a non-woven fabric in which mottling of the surface exists, but is less evident, the contrasting effects of light and shade are less marked, and the spots are generally sparser and of larger dimensions. These details regarding the appearance are clearly visible in FIG. 2.

Lastly, a non-woven fabric with a flat appearance can be defined as a non-woven fabric in which mottling of the surface is almost entirely lacking; the product appears to be uniform in colour, "flat", from any angle of observation. These details regarding the appearance are clearly visible in FIG. 3.

With reference to FIGS. 1-3 cited hereinabove, to the naked eye or in a photographic representation, the appearance of the non-woven fabric is more perceptible if the non-woven fabric is observed not from a "frontal" view, but "sideways", that is, with the observer positioned "to the side" of the inspection table.

The realisation of the composite non-woven fabric with such limited thicknesses involves critical production-related issues in the known process, associated with the poor resistance of the intermediate production products during the process. In particular, there are evident critical issues in connection with breakage of the bolt during the dyeing cycle. Moreover, reduction of the thickness tends to lead to softer raw intermediate products, which during the dyeing cycle tend to magnify the mottling appearance.

The Applicant has resolved this technical problem by developing a process for production of the microfibrous composite non-woven fabric that is modified with respect to the prior-art production process, so as to make it possible to obtain a composite material of a thickness equal to or less than 0.65 mm, preferably equal to or less than 0.60 mm, and with a flat or slightly mottled appearance. The appearance of the microfibrous non-woven fabric of the invention is therefore more homogenous compared to that of the known non-woven fabric.

The present invention thus concerns a process for obtaining a microfibrous non-woven fabric of a thickness equal to or less than 0.65 mm, preferably equal to or less than 0.60 mm, and having a flat or slightly mottled appearance, in which the splitting step is carried out as the last step of the process. In this manner, the dyeing point is reached with the raw product being thicker and therefore more resistant to breakage, and also stiffer and therefore less suited to generating the undesired mottled appearance. Furthermore, in the process the buffing conditions are modified in such a manner as to obtain a very limited nap length (less than the nap length that can be obtained with the known process) so as to obtain a flat and slightly mottled appearance. The nap length is equal to or less than 350 μm, preferably equal to or less than 300 μm. The buffing process is repeated on the two faces of the impregnated intermediate product. Lastly, the finishing conditions are modified in the process of the invention in such a manner as to obtain an identical appearance of the two faces of the product.

The present invention also concerns a composite microfibrous non-woven fabric that differs from the known in the art in that it is of a thickness equal to or less than 0.65 mm, preferable equal to or less than 0.60 mm, and in that it has a flat or slightly mottled appearance. The non-woven fabric of the invention is preferably characterised by a nap length preferably equal to or less than 350 μm, more preferably equal to or less than 300 μm. This non-woven fabric can be obtained with the process of the invention.

The subject matter of the invention also relates to coverings for consumer goods, particularly covers and cases for consumer goods, obtained by utilising the non-woven fabric of the invention. These consumer goods preferably include: portable devices for recording or reproducing sounds or images, portable entertainment devices, sports weapons or equipment, devices for personal well-being or health, telephones, handheld computers, laptops, and other electronic devices.

The invention also relates to the use of the non-woven fabric for the preparation of such coverings.

Further characteristics and advantages of the invention are illustrated herein below in detail, also with reference to the attached figures, wherein.

Figure 1:
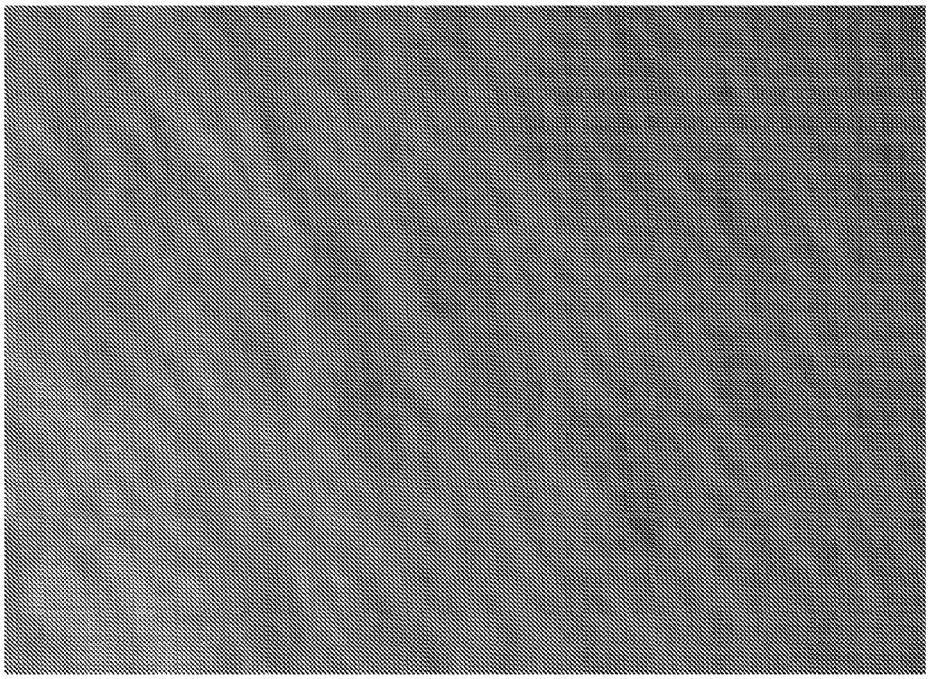
FIG. 1 shows a non-woven fabric with a mottled appearance, according to the definition provided hereinabove.
Figure 2:
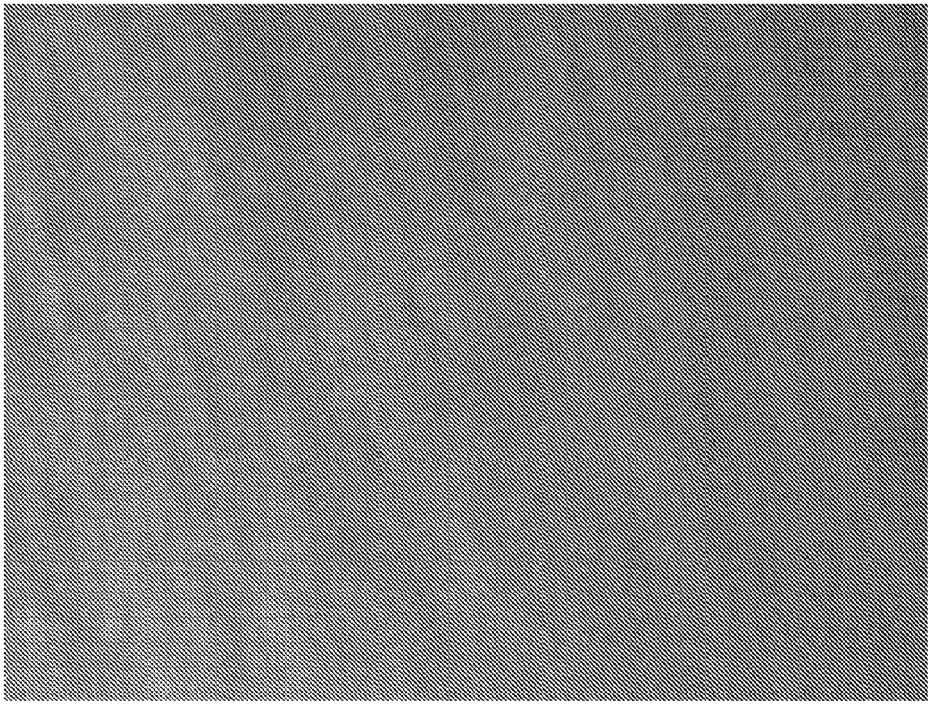
FIG. 2 shows a non-woven fabric with a slightly mottled appearance, according to the definition provided hereinabove.
Figure 3:
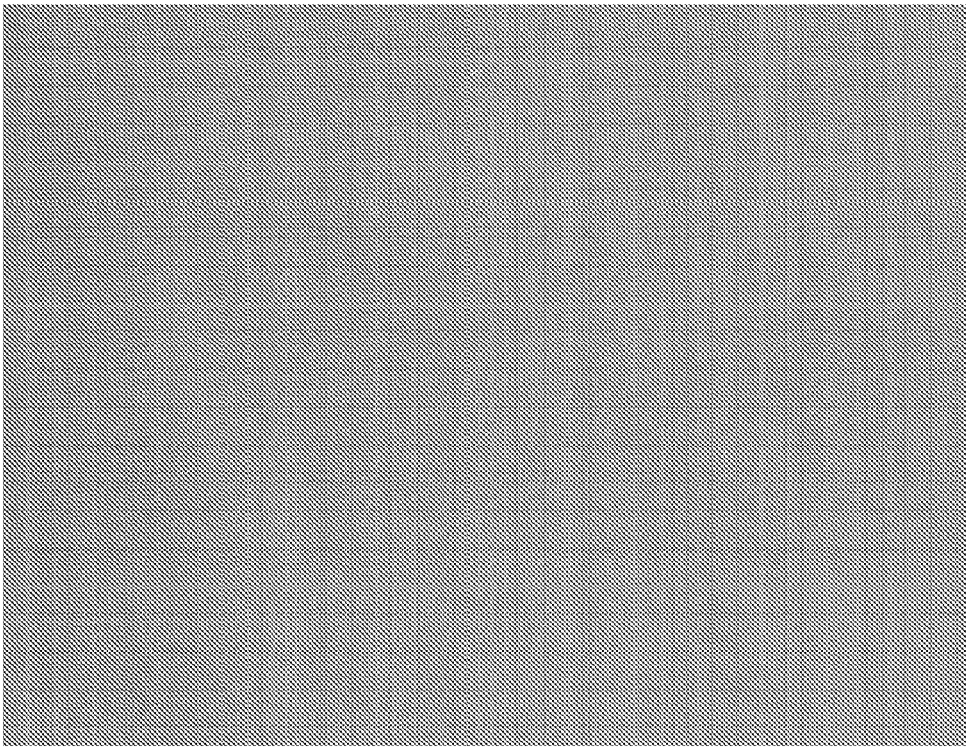
FIG. 3 shows a non-woven fabric with a flat appearance, according to the definition provided hereinabove.

The present invention concerns a process for obtaining a microfibrous non-woven fabric based on polyester or polyamide microfibres immersed in a polyurethane matrix and comprising the steps of:

A) spinning a bicomponent fibre with an island in the sea structure, in which the island component is microfibrous and the sea component, immiscible therewith, is soluble in solvents;

B) preparing a felt via a process of mechanical needle or water punching of the bicomponent fibre;

C) impregnating the felt with a polyvinyl adhesive;

D) dissolving the sea component in a selective solvent;

E) impregnating the felt with a polyurethane binding agent solution and removing the polyvinyl adhesive by dissolution in an organic solvent or water;

F) submitting the felt as per step E) to buffing on both faces, by rotating abrasive paper strips over both faces in a concurrent direction of orientation;

G) submitting the felt obtained in step F) (raw) to dyeing;

H) brushing the dyed product thus obtained on both faces so as to lend a concurrent orientation to the fibres on both faces;

I) cutting the product as per step H) in the direction of thickness so as to produce two identical laminates, each of half thickness.

The bicomponent fibre comprises polyester or polyamide microfibres, preferably polyethylene terephthalate (PET) (the island component) and a sea component preferably consisting of polystyrene (PS). The polyester microfibres preferably have a fibre count ranging between 0.10 and 0.25 dtex, more preferably between 0.12 and 0.20 dtex.

The bicomponent fibre obtained in step A) is then ironed, curled and cut to yield a short fibre (flock), preferably having a fibre count ranging between 3.5 and 4.5 dtex, a length ranging between 40 and 60 mm, and a crimp frequency ranging between 3 and 7 crimps/cm.

In a preferred embodiment, the flock fibre comprises 50% to 70% polyester by weight and 30% to 50% polystyrene by weight. The fibre section is preferably constituted by 16 microfibres of polyester englobed in polystyrene.

The intermediate felt product obtained in step B) by means of the needle punching process, has a density comprised between 0.1 and 0.3 g/cm$^2$ and a unit weight comprised between 300 and 550 g/m$^2$.

In step C), the polyvinyl adhesive is preferably an aqueous solution of polyvinyl alcohol (PVA). Impregnation is carried out at a temperature permitting dimensional shrinkage of the fibres, preferably at 95 to 98° C. Subsequently, the felt undergoes calendering to achieve a shrinkage in the thickness of over 8%.

In step D), the polystyrene sea component is dissolved preferably in trichloroethylene. Preferably, the felt remaining is submitted to gradual calendering until a density exceeding 0.2 g/cm$^2$ is reached.

Step E) begins by preparing an elastomeric polyurethane in an organic solvent, preferably dimethylformamide (DMF). The procedure for preparing elastomeric polyurethane is known in the field and, specifically, described in the patent application EP 0584511.

Once the elastomeric polyurethane has been obtained, the steps for impregnation of the felt and coagulation of the polyurethane are preferably conducted for a time period ranging from 30 minutes to two hours, at a temperature below 50° C.

The polyvinyl adhesive is then removed by washing with hot water, preferably boiling water. Then one proceeds by drying the felt impregnated with polyurethane.

In step F), the felt thus obtained is buffed with abrasive paper strips on the upper face so as to free the microfibres and generate the nap; the felt is rewound and submitted to buffing on the lower face, so that the direction of rotation of the abrasive paper strips generates a nap with a concurrent orientation between the upper and the lower surface. The abrasive paper preferably has a mesh value lower than 500 mesh, more preferably lower than 400 mesh. The intermediate product of the process thus generated is defined as the raw product.

In step G), the raw product is dyed according to the technologies traditionally employed for synthetic leathers. These dyeing processes are described, for example in the following patent applications: EP 0584511 and EP 1323859.

In step H), the semi-finished dyed product is preferably submitted to two brushings: a first brushing in a wet state and a second brushing after drying. The first brushing is carried out on both surfaces, preferably using bush-hammered rollers with a direction of rotation concurrent with the orientation of the fibres. The second brushing is applied after drying, and in this case as well, on both surfaces with a rotation of the brushes concurrent with the orientation of the fibres.

At the end of the above-described process, there is obtained a microfibrous non-woven fabric based on polyester or polyamide, impregnated with polyurethane, characterised by a thickness equal to or less than 0.65 mm, preferably equal to or less than 0.60 mm, and by a flat or slightly mottled appearance. The nap length is preferably equal to or less than 350 μm, more preferably equal to or less than 300 μm. The non-woven fabric thus has a very thin texture and a homogenous surface with a flat or slightly mottled appearance.

Owing to these characteristics, the non-woven fabric is ideal for use in the preparation of coverings for consumer goods, preferably covers and cases for consumer goods, including for example portable devices for recording or reproducing sounds or images, portable entertainment devices, sports weapons or equipment, devices for personal well-being or health, telephones, handheld computers, laptops and other electronic devices. Therefore, the subject matter of the invention also relates to these coverings, particularly covers and cases for consumer goods.

EXAMPLES

Example 1

A) A bicomponent flock is prepared, constituted by microfibres of polyethylene terephthalate (PET) (0.14-0.16 dtex) in a sea of polystyrene (PS), with the following characteristics:

1. fibre count: 4.2 dtex
2. length: 51 mm
3. curling frequency: 4-5/cm

In particular, the composition by weight of the flock is 57% PET and 43% PS. The fibre section is constituted by 16 microfibres of PET englobed by the PS.

B) An intermediate felt product is prepared by means of the punching of the bicomponent flock so as to obtain a product with a density comprised between 0.170 and 0.210 g/cm$^3$ and a unit weight comprised between 400 and 480 g/m$^2$.

C) The intermediate felt product is impregnated with an aqueous solution of PVA at a concentration of 12% and dried; subsequently it is immersed in a trichloroethylene bath until complete elimination of the sea of PS and dried.

D) An elastomeric polyurethane is prepared separately in a solution of dimethylformamide (DMF). In a first step (pre-polymerisation), polycaprolactone (PCL) and polytetrahydrofuran (PTHF) with a molecular weight of 2000 amu are reacted at 63° C., under agitation, with diphenylmethane diisocyanate (MDI) in an isocyanate/diol molar ratio of 2.7/1. After 2.5 hours of reaction, DMF is added so as to obtain a 25% pre-polymer solution with a free NCO content of 1.46%.

E) Maintaining the solution of pre-polymer obtained in step D) at 38° C., water and dibutylamine (DBA) are added so as to obtain a polyurethane-polyurea with a molecular weight of 15000 amu. The solution is heated to a temperature of 63° C. and maintained under agitation for 8 hours until reaching a final viscosity of 20,000 cP at 20° C. The solution is diluted to 14% by weight with DMF and Tinuvin® 622 and Tinuvin® 234 are added thereto. Following coagulation in water, the polymer contained in the solution is capable of generating high-porosity structures.

F) The felt obtained in step C) is impregnated with the polyurethane solution and, after a residence time of about 1 hour at a temperature lower than 48° C., it generates a coagulated product. The latter is washed in a bath of boiling water so as to completely remove the PVA content and is then dried. The material thus obtained is buffed with abrasive paper strips on the upper face so as to free the microfibres and generate the nap; the material is rewound and submitted to buffing on the lower face, so that the direction of rotation of the abrasive paper strips generates a nap with a concurrent orientation between the upper and the lower surface.

G) The raw intermediate product obtained in step F) is dyed according to the technologies traditionally employed for synthetic leathers.

H) The wet dyed product is submitted to brushing on both surfaces using bush-hammered rollers with a direction of rotation concurrent with the orientation of the fibres. After drying, a second brushing is applied, and in this case as well, by working on both surfaces with a rotation of the brushes concurrent with the orientation of the fibres.

I) The product obtained in step H) is cut in half in the direction of thickness so as to obtain two identical laminates, each of half thickness.

Figure 4:
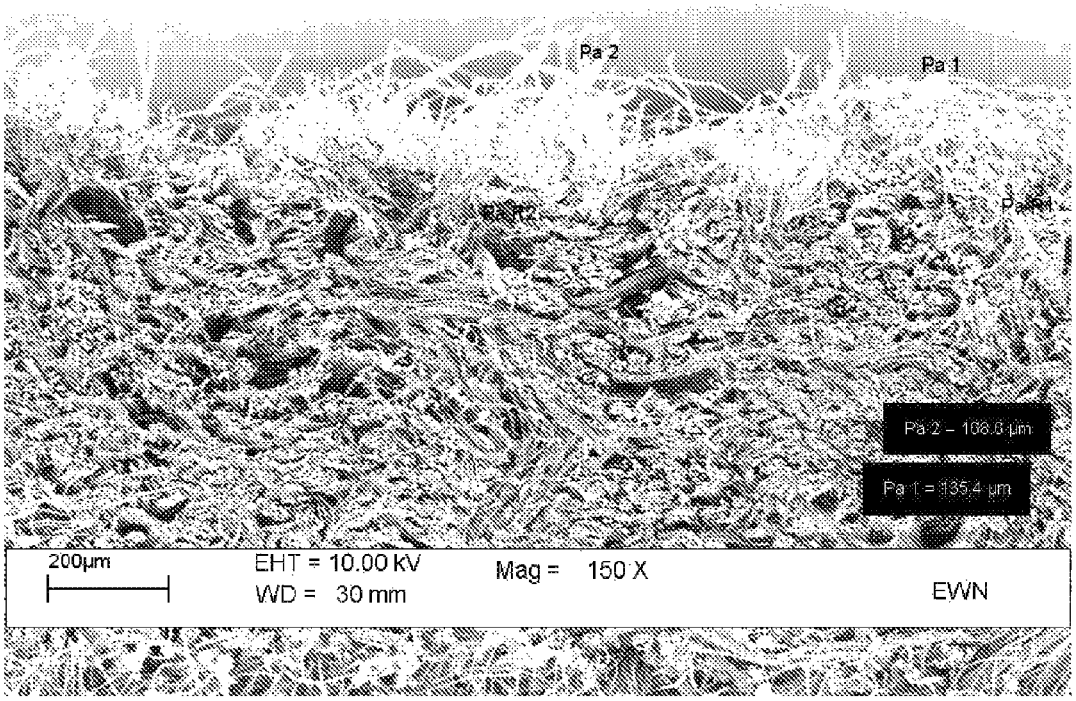
FIG. 4 is a photograph of the non-woven fabric of Example 1, taken with a scanning electron microscope (SEM); the photograph shows the measurement of the nap length.
Figure 5:
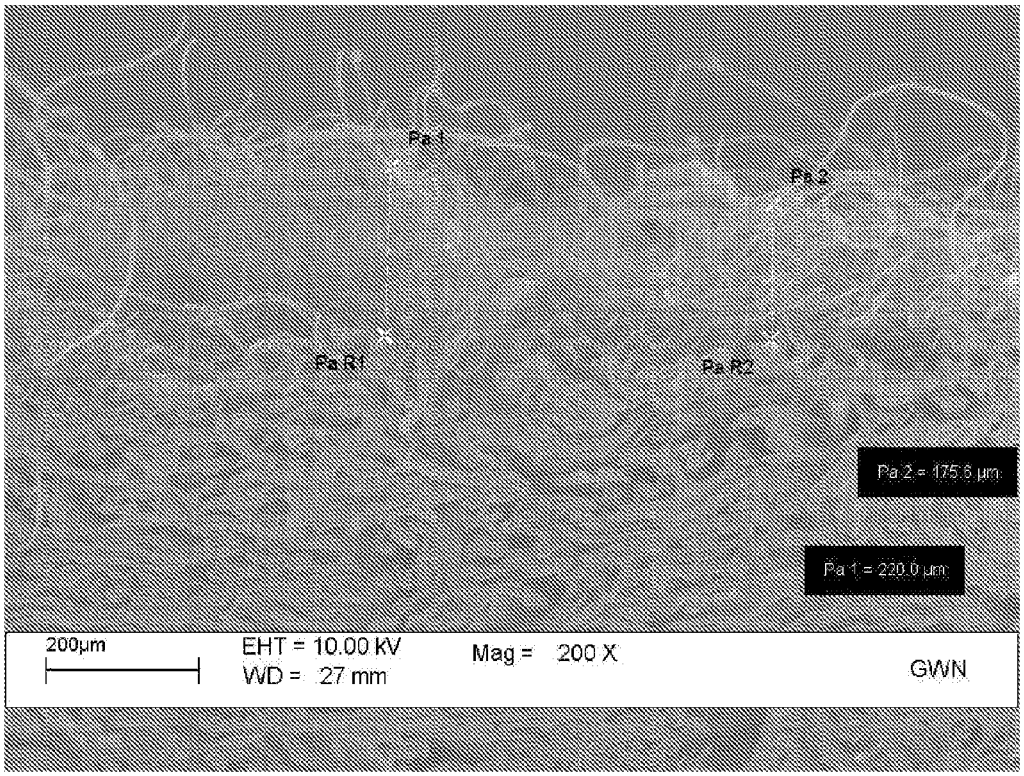
FIG. 5 is a photograph of the non-woven fabric of Example 2, taken with a scanning electron microscope (SEM); the photograph shows the measurement of the nap length.

L) The finished product obtained has a homogenous surface with a flat appearance and a nap length between 135 and 170 μm; the nap length is shown in the photograph appearing in FIG. 4.

Example 2

A) A bicomponent flock is prepared, constituted by microfibres of PET (0.19-0.21 dtex) in a sea of PS, with the following characteristics:

1. fibre count: 4.2 dtex
2. length: 51 mm
3. curling frequency: 5-6/cm

In particular, the composition by weight of the flock is 80% PET and 20% PS. The fibre section is constituted by 16 microfibres of PET englobed by the PS.

B) An intermediate felt product is prepared by means of the punching of the bicomponent flock so as to obtain a product with a density comprised between 0.170 and 0.210 $g/cm^3$ and a unit weight comprised between 400 and 480 $g/m^2$.

C) The intermediate felt product is impregnated with an aqueous solution of PVA at a concentration of 12% and dried; subsequently it is immersed in a trichloroethylene bath until complete elimination of the sea of PS and dried.

D) An elastomeric polyurethane is prepared separately in a solution of DMF. In a first step (pre-polymerisation), PCL and PTHF with a molecular weight of 2000 amu are reacted at 63° C., under agitation, with MDI in an isocyanate/diol molar ratio of 2.7/1. After 2.5 hours of reaction, DMF is added so as to obtain a 25% pre-polymer solution with a free NCO content of 1.46%.

E) Maintaining the solution of pre-polymer obtained in step D) at 38° C., water and DBA are added so as to obtain a polyurethane-polyurea with a molecular weight of 15000 amu. The solution is heated to a temperature of 63° C. and maintained under agitation for 8 hours until reaching a final viscosity of 20,000 cP at 20° C. The solution is diluted to 14% by weight with DMF and Tinuvin® 622 and Tinuvin® 234 are added thereto. Following coagulation in water, the polymer contained in the solution is capable of generating high-porosity structures.

F) The felt obtained in step C) is impregnated with the polyurethane solution and, after a residence time of about 1 hour at a temperature lower than 48° C., it generates a coagulated product. The latter is washed in a bath of boiling water so as to completely remove the PVA content and is then dried. The material thus obtained is buffed with abrasive paper strips on the upper face so as to free the microfibres and generate the nap; the material is rewound and submitted to buffing on the lower face, so that the direction of rotation of the abrasive paper strips generates a nap with a concurrent orientation between the upper and the lower surface.

G) The raw intermediate product obtained in step F) is dyed according to the technologies traditionally employed for synthetic leathers.

H) The wet dyed product is submitted to brushing on both surfaces using bush-hammered rollers with a direction of rotation concurrent with the orientation of the fibres. After drying, a second brushing is applied, and in this case as well, by working on both surfaces with a rotation of the brushes concurrent with the orientation of the fibres.

I) The product obtained in step H) is cut in half in the direction of thickness so as to obtain two identical laminates, each of half thickness.

L) The finished product obtained has a surface with a slightly mottled appearance, a nap length varying from 175 to 220 μm and a nap that is less dense and homogeneous compared to the preceding example; the nap length is shown in the photograph of Example 2.

Example 3

Comparative Example

A) A bicomponent flock is prepared, constituted by microfibres of PET (0.14-0.16 dtex) in a sea of PS, with the following characteristics:

1. fibre count: 4.2 dtex
2. length: 51 mm
3. curling frequency: 4-5/cm

In particular, the composition by weight of the flock is 57% PET and 43% PS. The fibre section is constituted by 16 microfibres of PET englobed by the PS.

B) An intermediate felt product is prepared by means of the punching of the bicomponent flock so as to obtain a product with a density comprised between 0.170 and 0.210 $g/cm^3$ and a unit weight comprised between 400 and 480 $g/m^2$.

C) The intermediate felt product is impregnated with an aqueous solution of PVA at a concentration of 12% and dried; subsequently it is immersed in a trichloroethylene bath until complete elimination of the sea of PS and dried.

D) An elastomeric polyurethane is prepared separately in a solution of DMF. In a first step (pre-polymerisation), PCL and PTHF with a molecular weight of 2000 amu are reacted at 63° C., under agitation, with MDI in an isocyanate/diol molar ratio of 2.7/1. After 2.5 hours of reaction, DMF is added so as to obtain a 25% pre-polymer solution with a free NCO content of 1.46%.

E) Maintaining the solution of pre-polymer obtained in step D) at 38° C., water and DBA are added so as to obtain a polyurethane-polyurea with a molecular weight of 15000 amu. The solution is heated to a temperature of 63° C. and maintained under agitation for 8 hours until reaching a final viscosity of 20,000 cP at 20° C. The solution is diluted to 14% by weight with DMF and Tinuvin® 622 and Tinuvin® 234 are added thereto. Following coagulation in water, the polymer contained in the solution is capable of generating high-porosity structures.

F) The felt obtained in step C) is impregnated with the polyurethane solution and, after a residence time of about 1 hour at a temperature lower than 48° C., it generates a coagulated product. The latter is washed in a bath of boiling water so as to completely remove the PVA content and is then dried.

G) The product obtained in step F) is cut in half in the direction of thickness so as to obtain two identical laminates, each of half thickness.

H) The material thus obtained is buffed with abrasive paper strips on the upper face so as to free the microfibres and generate the nap;

I) The raw intermediate product obtained in step H) is dyed according to the technologies traditionally employed for synthetic leathers, but the reduced physical mechanical properties of the material make this step a particularly crucial, as there is a high incidence of splitting and tearing that markedly reduce the manufacturing yield.

L) The wet dyed product is submitted to brushing using bush-hammered rollers with a direction of rotation concurrent with the orientation of the fibres. After drying, a second brushing is applied, with a rotation of the brushes concurrent with the orientation of the fibres.

M) The finished product obtained has a surface with a highly mottled effect (mottling) and nap length typical of the microfibrous material of the prior art.

The mechanical properties have been determined for the raw semi-finished products obtained with the process of the invention (Example 1), with the known process of the prior art (which is similar to that described in Example without the greater thickness of the product realised), and with the process of Comparative Example 3.

| | | Raw semi-finished product obtained with the process of the invention (Example 1) | Raw semi-finished product obtained with the process of the prior art | Raw semi-finished product of Example 3 |
|---|---|---|---|---|
| Thickness (mm) | | 1.03 | 0.74 | 0.57 |
| UNIT WEIGHT ($g/m^2$) | | 354 | 242 | 180 |
| DENSITY ($g/cm^3$) | | 0.344 | 0.327 | 0.315 |
| 20% Modulus | L | 6.1 | 3.8 | 2.4 |
| (Kg/cm) | T | 1.4 | 0.9 | 0.5 |
| ELMENDORF | L | 2.9 | 1.1 | 1.5 |
| Tear Strength | T | 1.2 | 0.7 | 0.8 |
| (Kg) | | | | |
| TENACITY | L | 15.7 | 8.1 | 6.0 |
| (Kg/cm) | T | 9.5 | 6.2 | 3.6 |
| ELONGATION | L | 76.2 | 64.4 | 71.1 |
| AT BREAK (%) | T | 135.2 | 120.5 | 112.4 |

[NOTE: L = Longitudinal - C = Transversal]

The semi-finished product obtained with the process of the prior art, which provides that the splitting step precede the dyeing step, has modulus and tenacity values that lend adequate resistance to the dyeing process. Reducing the thickness to that required by the application, with the process being equal, the tenacity characteristics in a longitudinal direction (winding direction of the non-woven fabric) and above all, in a transversal direction (see Example 3), drop to levels that are too low to allow for adequate resistance of the product to the stresses inflicted during the dyeing process. The problem can be resolved with the process constituting the subject matter of the invention (see Example 1), in which the raw semi-finished product has modulus and tenacity values that are even higher than those of the known process and thus highly suitable for withstanding the stresses of the dyeing process.

The invention claimed is:

1. A microfibrous non-woven fabric, said fabric having a thickness equal to or less than 0.65 mm and a flat or slightly mottled appearance obtainable with a process comprising the steps of:

A) spinning a bicomponent fiber with an island in the sea structure, wherein the island component is microfibrous and the sea component, immiscible therewith, is soluble in solvents;

B) preparing a felt via a process of mechanical needle or water punching of the bicomponent fiber;

C) impregnating the felt with an adhesive;

D) dissolving the sea component in a selective solvent;

E) impregnating the felt with a polyurethane binding agent solution and removing the adhesive by dissolution in an organic solvent or water;

F) submitting the felt as per step E) to buffing on both faces, by rotating abrasive paper strips over both faces in a concurrent direction of orientation;

G) submitting the felt as per step F) to dyeing;

H) brushing the dyed felt on both faces so as to lend a concurrent orientation to the fibers on both faces;

I) cutting the product of step H) in the direction of thickness so as to produce two identical laminates, each of half thickness.

2. The microfibrous non-woven fabric according to claim 1, having a nap length equal to or less than 350 μm.

3. A covering for a consumer good, said covering comprising the non-woven fabric according to claim 1.

4. The covering according to claim 3, said covering being a cover or case for a consumer good.

5. The covering according to claim 4, wherein said consumer good is selected from the group consisting of portable devices for recording or reproducing sounds or images, portable entertainment devices, sports weapons, sports equipment, devices for personal well-being or health, telephones, handheld computers and laptops.

6. A method for preparing a covering for a consumer good, comprising a step of providing a microfibrous non-woven fabric according to claim 1 and using said fabric to prepare said covering.

7. The microfibrous non-woven fabric according to claim 1, wherein said fabric has a thickness equal to or less than 0.60 mm.

8. The microfibrous non-woven fabric according to claim 1, having a nap length equal to or less than 300 μm.

9. The covering according to claim 4, wherein said consumer good is an electronic product.

10. The covering according to claim 4, wherein said consumer good is an electronic device.

11. The method according to claim 6, wherein said covering is a cover or case for a consumer good.

12. The method according to claim 11, wherein said consumer good is an electronic product.

* * * * *